US005373915A

United States Patent [19]

Tremblay

[11] Patent Number: 5,373,915

[45] **Date of Patent: * Dec. 20, 1994**

[54] PASSENGER LIFT WITH AN ELECTRIC SAFETY INTERLOCK

[75] Inventor: Jules M. Tremblay, Sunland, Calif.

[73] Assignee: Ricon Corporation, Pacoima, Calif.

[ * ] Notice: The portion of the term of this patent subsequent to Jul. 20, 2010 has been disclaimed.

[21] Appl. No.: 91,996

[22] Filed: Jul. 14, 1993

Related U.S. Application Data

[63] Continuation-in-part of Ser. No. 835,255, Feb. 12, 1992, Pat. No. 5,228,538.

[51] Int. Cl.[5] ..... B66B 9/20

[52] U.S. Cl. ..... 187/201; 414/921; 180/270; 187/242; 187/280; 187/285; 187/298

[58] Field of Search ..... 187/9 R, 1 R; 180/268, 180/270; 414/921, 540, 541, 539, 678

[56] References Cited

U.S. PATENT DOCUMENTS

| | | | |
|---|---|---|---|
| 4,141,089 | 2/1979 | Krumbeck | 4/172 |
| 4,420,286 | 12/1983 | Hanson | 414/539 |
| 4,785,906 | 11/1988 | Kang | 180/270 |
| 4,808,056 | 2/1989 | Oshima | 414/921 |
| 4,904,916 | 2/1990 | Gisske et al. | 318/649 |
| 4,913,264 | 4/1990 | Voves et al. | 187/12 |

FOREIGN PATENT DOCUMENTS

| | | |
|---|---|---|
| 0419957 | 4/1991 | European Pat. Off. . |
| 2468486 | 5/1991 | France . |

*Primary Examiner*—Kenneth W. Noland

[57] ABSTRACT

A passenger lift incorporates an electronic safety interlock to prevent all movement of the lift, until a restraining belt is fastened. In some embodiments, the interlock is a normally open electric switch located inside the restraining belt's buckle. The switch is closed and the movement of the lift actuated only when the restraining belt's matingly interlocking tab is inserted in the buckle.

9 Claims, 3 Drawing Sheets

PASSENGER LIFT WITH AN ELECTRIC SAFETY INTERLOCK

RELATED SUBJECT MATTER

This application is a continuation-in-part of application Ser. No. 07/835,255, filed Feb. 12, 1992 entitled "Passenger Lift with our Electric Safety Interlock" issued as U.S. Pat. No. 5,228,538 our Jul. 20, 1990.

BACKGROUND OF THE INVENTION

1. Field of the Invention

This invention relates to the mechanical arts. In particular, it relates to an improved passenger lift integrating safety features.

2. Discussion of the Prior Art

There is an increasing sensitivity to the need for facilitating the mobility of all members of our society, including people who have difficulty in walking and people who use wheelchairs. Such people often have difficulty moving between different levels, such as getting into and out of vehicles and using stairways. Consequently, there is a great need for passenger lifts to transport people into and out of vans and buses and between the floors of buildings.

Passenger lifts, per se, are well known in the art. Representative passenger lifts are described in U.S. Pat. Nos. 4,534,450 and Re. 31,178. To be effective, passenger lifts must be reliable, cost effective and, most importantly, safe.

Among the various types of safety features which have been included in wheelchair lifts are restraining devices, such as restraining belts and barrier plates -plates attached to the sides and ends of a lift platform, perpendicular to the platform's surface. These restraining devices help prevent wheelchairs from rolling off lifts when the lifts are in operation.

For example, U.S. Pat. No. 4,726,730 discloses an assembly for lifting and tilting a wheelchair. The wheelchair and its passenger are held in place by safety belts passing along platform sides and over the wheelchair and its occupant. Ricon Corporation, Pacoima, Calif. offers wheelchair lifts incorporating restraining belts extendable between a pair of handrails and barrier plates along the front and side edges of the lifts' platform. U.S. Pat. No. 5,026,244 discloses a wheelchair lift having both a retention strap, drawn across the front of a wheelchair and attached to a handrail, and a barrier plate positioned at the front edge of the platform.

U.S. Pat. No. 5,052,521 discloses a stairway lift accommodating either a wheelchair or a fixed seat. The lift contains two guard arms lowered during operation and three platform flaps raised during operation. The distal end of each guard arm is provided with an inwardly directed right angle bend, such that a rigid, substantially rectangular, outer perimeter is formed by the arms in conjunction with the lift's vertical housing when both arms are in their lowered position.

Barrier plates and other restraining devices automatically deployed during the operation of a lift are known in the art. For example, U.S. Pat. Nos. 3,651,965, 4,133,437, 4,442,921 and 5,040,936 disclose lifts having barrier plates automatically raised into place, when the lifts are in operation. U.S. Pat. No. 4,457,402 discloses a wheelchair lift having an automatic mechanism for moving power safety gates from their open to their closed positions, when the platform is deployed.

Barrier plates which must be in place in order to operate a wheelchair lift are also known in the art. U.S. Pat. Nos. 4,479,753 and Re. 33,595 disclose movable barrier plates, placed in their upright position before the platform will move up or down. U.S. Pat. No. Re. 33,595 describes a safety barrier switch triggered when the safety barrier is raised.

U.S. Pat. No. 4,420,286 discloses vehicles outfitted with wheelchair lifts. The lifts have several interlock switches to prevent operation of the lift in the event the vehicle transmission is not in "park", or a manually operable arming switch is not closed, or a safety flap mounted on the loading platform is not in an up position, or the platform is not in its fully projected position.

U.S. Pat. No. 4,804,308 discloses a wheelchair lift having safety gates actuated by an air cylinder. In the preferred embodiment, interlocks prevent operation of the air cylinder until the platform is deployed.

U.S. Pat. No. 3,651,965 discloses a wheelchair lift having a mainline switch which must be closed before any of the lift's hydraulically actuated functions begin. It is also known to include electric belt interlocks in the seat belts of automobiles. With such interlocks, the automobile cannot be started unless the seat belt is fastened.

SUMMARY OF THE INVENTION

In accordance with the invention, a passenger lift incorporates an electric safety interlock in a restraining belt. The passenger lift has a mobile platform that is driven to transport passengers between different terminal levels and a drive means for actuating the platform between the different levels. The mobile platform defines a lift surface with a front edge and two opposing sides. Spaced apart side passenger supports are disposed over the lift surface, above at least a portion of each of the opposing sides.

The restraining belt is formed by a buckle attached to one of the side supports, and a strap attached to the opposed side support and terminating in a tab which matingly interlocks with the buckle. The buckle and the strap are fixed along the side passenger supports, so that when the buckle is matingly interlocked with the tab, the strap extends across the platform and forms a safety restraint between a passenger on the platform and the front edge of the platform.

The safety of passengers being transported on such a lift is significantly increased by an electric safety interlock included in the buckle. The electric safety interlock prevents all movement of the lift, until the restraining belt is fastened. In some embodiments, the interlock is a normally open electric switch located inside the buckle. The switch is closed and the movement of the lift actuated, only when a matingly interlocking tab is inserted in the buckle.

In some embodiments, the lift is adapted to transport passengers in wheelchairs between different terminal levels. The restraining belt containing the electric safety interlock is affixed to handrails located on each side of the lift platform and the restraining belt positioned, so that when it is engaged it forms a restraint between the wheelchair and the front edge of the platform.

And in some embodiments, the lift surface is the seat of a chair and the restraining belt is attached to opposing sides of the seat, so that when the belt is engaged it crosses the lap of a passenger occupying the seat. The passenger lift in accordance with the invention provides a surprisingly simple and inexpensive, yet reliable and effective means for preventing passengers from falling off the lift, as the passengers are transported from one level to another.

DETAILED DESCRIPTION OF THE PREFERRED EMBODIMENTS

As required, details of illustrative embodiments of the invention are disclosed. However, it is to be understood that these embodiments merely exemplify the invention which may take forms different from the specific embodiments disclosed. Accordingly, structural and functional details are not necessarily to be interpreted as limiting, but as a basis for the claims. For example, the invention will be illustrated with a passenger lift, all of whose functions are actuated by a single hydraulic cylinder. However, as will be apparent to one skilled in the pertinent art, the various functions could be actuated by a plurality of hydraulic cylinders or they could be actuated by other means, such as by one or more electric motors.

Figure 1:
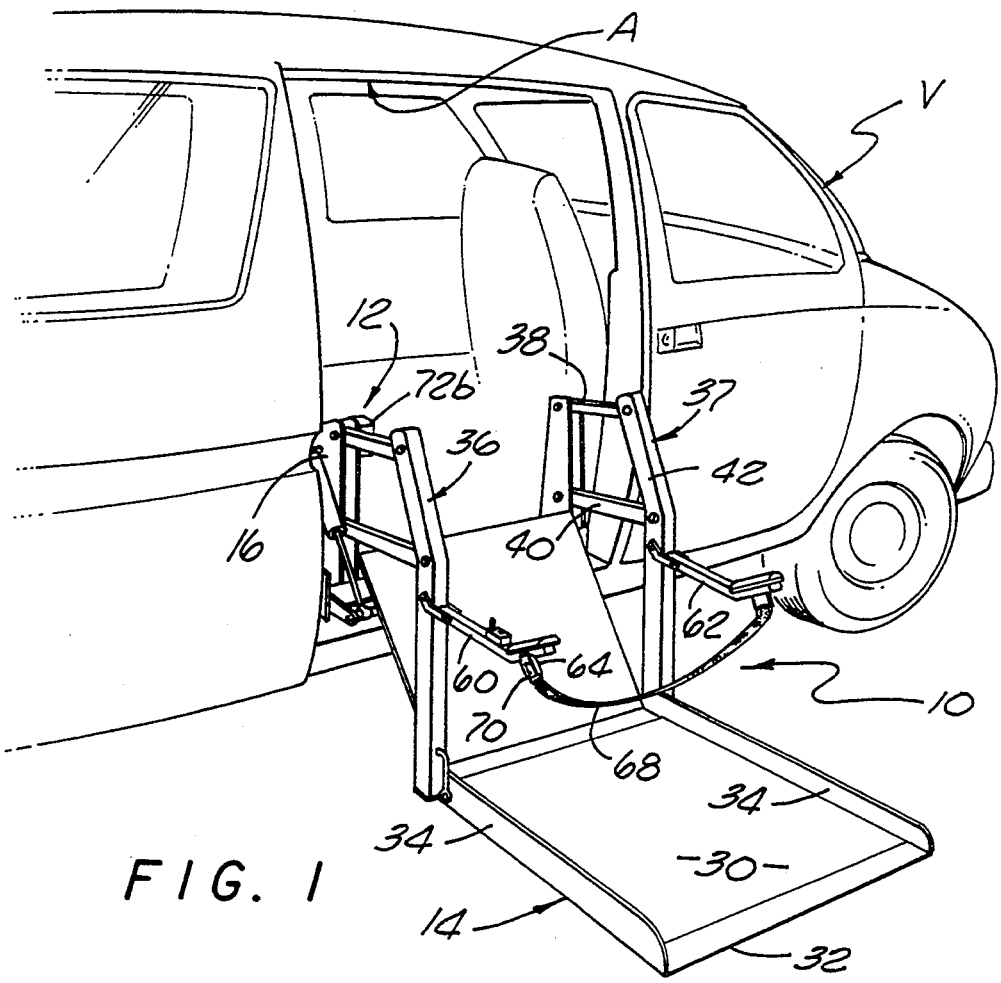
FIG. 1 is a perspective view of a portion of a vehicle containing a passenger lift in accordance with the invention.

Referring to FIG. 1, there is shown a portion of a vehicle containing a lift for transporting a passenger in a wheelchair (not shown) in and out of the vehicle. The passenger lift 10 has a mounting assembly 12 for securing the passenger lift in the vehicle V; a mobile platform 14 for transporting a passenger from street level onto the floor of the vehicle and from the floor of the vehicle back to the street; and a drive means 16 for actuating the movement of the platform between the two different levels.

The passenger lift 10 is affixed to the vehicle V adjacent an access opening A. The drive actuating means 16 moves the platform 14 between a lowered, loading position outside the vehicle V, a raised, entry position level with the floor of the vehicle, and a storage position inside the vehicle.

When the passenger lift 10 is in the loading position, a wheelchair can be rolled onto the platform 14. The lift 10 is then actuated to raise the platform 14 to the entry position, from which the wheelchair is rolled into the vehicle V. Next, the lift 10 is actuated to draw the platform 14 into the vehicle V and into a storage position.

When the wheelchair passenger wishes to get out of the vehicle V, the procedure is reversed. The lift 10 is actuated to move the platform 14 to the entry position. The wheelchair is rolled onto the platform 14, which then is lowered to the ground. After the wheelchair is off the platform 14, the entry procedure is repeated, returning the platform to the storage position.

Figure 3:
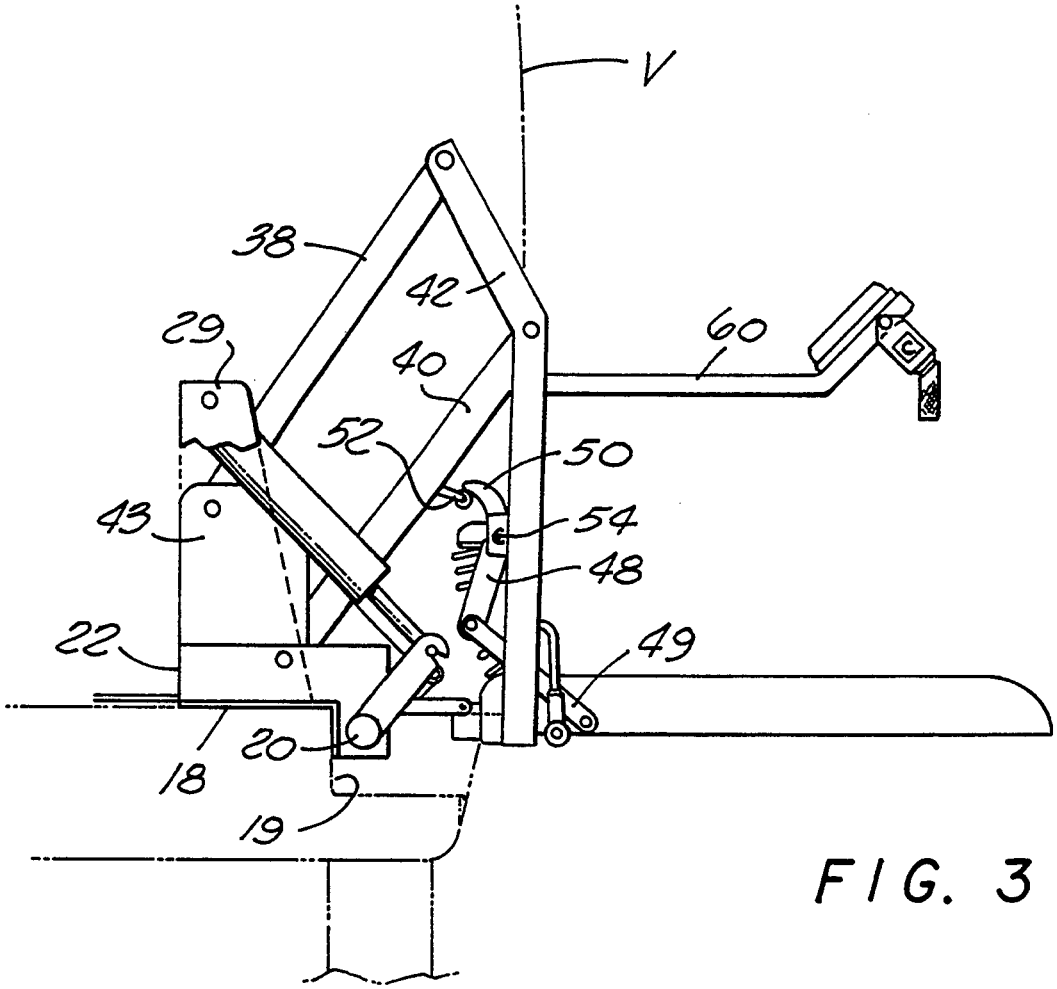
FIG. 3 is a side view of the lift shown in FIG. 1.
Figure 4:
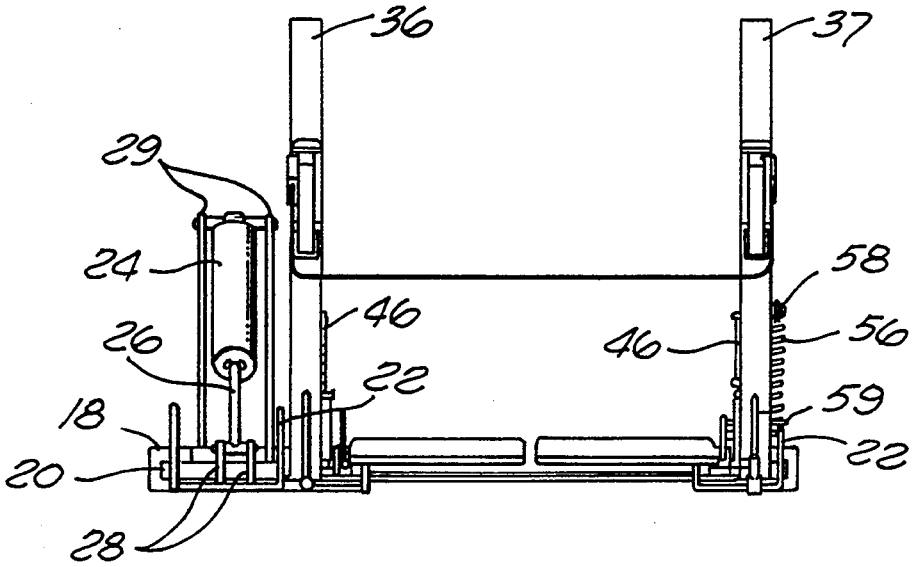
FIG. 4 is a front view of the lift shown in FIG. 1.

Referring to FIGS. 3 and 4, side and front views of the passenger lift are shown. The passenger lift is affixed to the vehicle V using an anchoring plate 18, a portion engaging a floor board cavity 19. A transverse shaft 20 having a length comparable to the length of the anchoring plate 18 is rotably supported, in front of the anchoring plate alongside the section engages the floorboard cavity 19, by means of three brackets 22.

A hydraulic actuating cylinder 24 has a hydraulic cylinder piston rod 26 extending from one end. The piston rod 26 is connected to the transverse shaft 20 by means of two parallel radial arms 28 secured to the shaft. The piston rod 26 is pivotally connected to one end of each radial arm 28. The other end of each radial arm 28 is welded to the transverse shaft 20.

The other end of the hydraulic cylinder 24 is pivotally supported by two bracket plates 29 upstanding from and secured to the anchoring plate 18. The hydraulic cylinder 24 is used in conjunction with a fluid pump and reservoir (not shown) installed anywhere in the vehicle.

Referring additionally to FIG. 1, the platform 14 defines a generally rectangular lift surface 30, with a front edge 32 and with two opposing sides 34. The platform 14 is pivotally connected to the vehicle V by a pair of spaced armatures 36 and 37, each formed of upper and lower parallel links 38 and 40, respectively, and a vertical link 42. Each set of parallel links 38 and 40 is pivotally secured at one end to the vertical link 42 and at the other end to an armature bracket 43. In addition, the lower parallel links 40 on both armatures 36 are connected to the transverse shaft 20 by means of an articulated linkage 44, to raise the platform 14 under the action of the hydraulic cylinder 24.

Each of the armatures 36 and 37 defines with its bracket 43 a deformable parallelogram. This design enables the platform 14 to maintain a substantially horizontal position as it is raised from the ground (or loading position) to the floor of the vehicle V (or entry position) and vice versa.

While the platform 14 normally remains in a plane parallel to the ground when the lift assembly is in use, for storage the platform is raised to a vertical position and shifted within the vehicle V. The vertical positioning reduces the storage size and the shifting allows closing of the vehicle door. The platform 14 is moveable in between the vertical plane and the horizontal plane by means of a pair of articulated linkages 46 having upper and lower links 48 and 49, respectively, pivotally secured together and installed in between the vertical links 42 and the sides of the platform 34.

The upper links 48 terminate in curved sections 50. When the platform 14, during its upper movement, has reached the entry position, level with the vehicle floor, the curved sections 50 abut on a short rod 52 located on the lower side of the lower parallel links 40 causing the rotation of the upper links 48 around their axes 54 and the displacement of the lower links 49 pull on the platform 14 to pivot it upwardly.

Means are also included to lower the platform 14 from its storage position, back to its horizontal position, for its subsequent use by a passenger. The means are installed on armature 37 and comprise a tension spring 56 secured at one end to a support 58 extending from the platform 14 and at the other end to a hook 59 secured to the lower section of the vertical link 42. The spring 56 forces the articulated linkage 46 to rotate the platform 14 downwardly.

Figure 2:
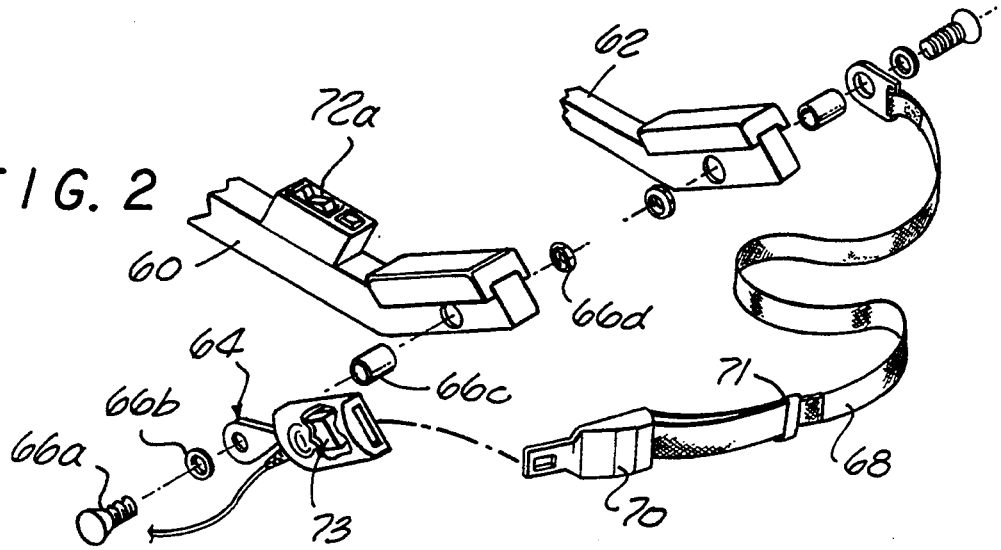
FIG. 2 is an exploded view, partially cut away, of a portion of the passenger lift of FIG. 1, illustrating the electric safety interlock.

Referring additionally to FIG. 2, there is shown an exploded view, partially cut away, of a portion of the passenger lift of FIG. 1 illustrating an electric safety interlock. Spaced apart side supports or handrails 60 and 62 are pivotally attached to the vertical links 43, so that they extend along a portion of each side 34 above the lift surface 30.

A buckle 64 is connected to the distal end of one of the handrails 60 by inserting a bolt 66*a* through a washer 66*b* and then through a boss 66*c* disposed in a hole drilled through the handrail and securing the bolt with a nut 66*d*. One end of a flexible strap 68 is connected to the distal end of the opposing side support 62 by inserting a bolt through a washer and then through a boss disposed in a hole drilled through the handrail and securing the bolt with a nut. The other end of the flexible strap 68 terminates in a tab 70, which matingly interlocks with the buckle 64. The strap 68 contains means for adjusting its length 71, so that it is easily adjusted to accommodate passengers and wheelchairs of varying sizes. The buckle 64 and the strap 66 are fixed along the handrails 60 and 62, so that when they are matingly interlocked they extend across the lift surface 30 and form a safety restraint between a passenger on the platform 14 and the front edge 32 of the platform.

The operation of the passenger lift is controlled from either one of a duplicate set of control boxes. One control box 72*a* is secured to one of the handrails 60, so that the lift can be readily operated by the passenger. The other control box 72*b* is secured on the mounting assembly 12, where it is readily accessible to an attendant.

The control boxes 72 carry a normally neutral switch which moves selectively to complete "up" and "down" electrical circuits (FIG. 5) for the actuation of the hydraulic system. Using a control box 72, the operator can lower the platform to the ground from the van, initiate movement of the entry position after boarding the platform, fold the platform into the storage position after entering the van, return the platform to the entry position from inside the van preparatory to exiting, and lower the platform to the ground from the entry position.

A normally open electric switch 73 is located inside the buckle 64. When the tab 70 is inserted in the buckle 64, an electrical circuit is completed through the switch 73. The circuit is designed so that the main control power of the lift passes through the switch. In this way, all lift functions are disabled when the restraint belt is not fastened.

Figure 5:
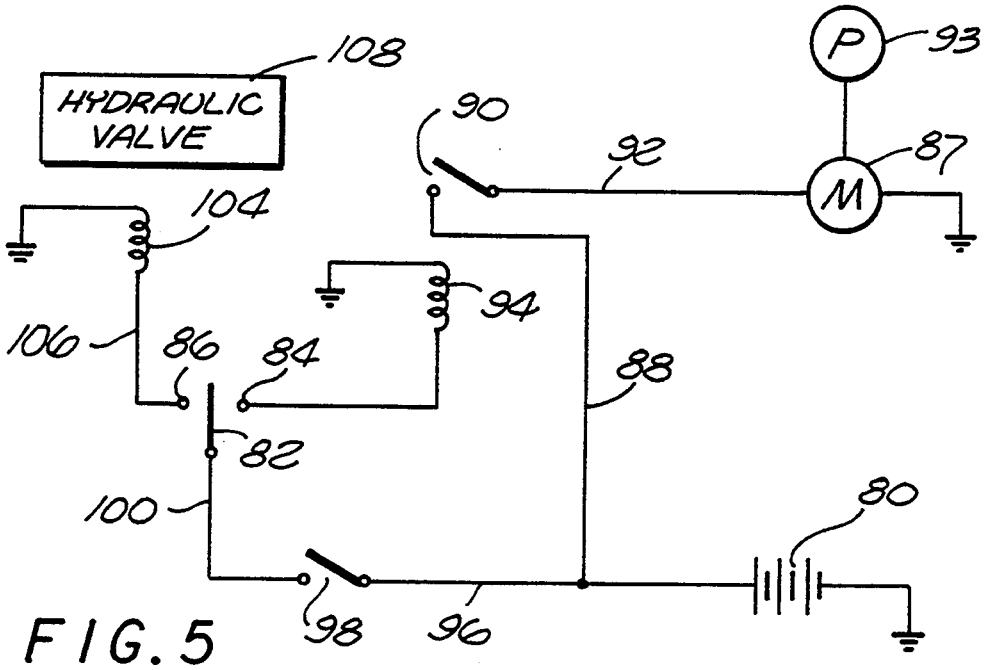
FIG. 5 is a schematic diagram of an electrical control system for a lift in accordance with the invention.

Referring now to FIG. 5, there is shown a schematic diagram of an electrical control system for the lift. The whole mechanism is operated by battery 80, which can be the battery supplying electrical energy for the spark of the vehicle, or can be a separate battery.

The electrical control system includes manually controlled switch arm 82 normally disposed in a neutral position and movable selectively into engagement with either of two contacts 84 or 86. An "up" circuit is formed from battery 80, through line 88, switch 90, and line 92 leading to the motor 87. This actuates the hydraulic pump 93, to pump motive fluid from the reservoir, into the hydraulic cylinder.

Switch 90 is closed by a solenoid coil 94 energized by a circuit from the battery 80, including line 96, normally open switch 98, line 100, switch arm 82, contact 84, and line 102 leading to solenoid coil 94. When the platform is to be raised, arm 82 is moved to contact 84, thereby forming part of the circuit needed to close switch 90. However, the circuit cannot be completed until the normally open switch 98 is also closed. Accordingly, the "up" circuit only can be completed and the platform raised when the buckle and tab are interlocked.

A "down" circuit is formed from battery 80, through line 96, normally open valve 98, line 100, switch arm 82, contact 86, and line 106 leading to hydraulic valve solenoid 104. When hydraulic valve solenoid 104 is energized it actuates a hydraulic valve 108 allowing the platform to be lowered under the force of its own weight. Accordingly, when the platform is to be lowered, the arm 82 is moved to contact 86, thereby forming part of the "down" circuit. Again however, the circuit can only be completed and the platform lowered when the normally open switch 98 is closed, i.e. when the buckle and tab are interlocked.

Figure 6:
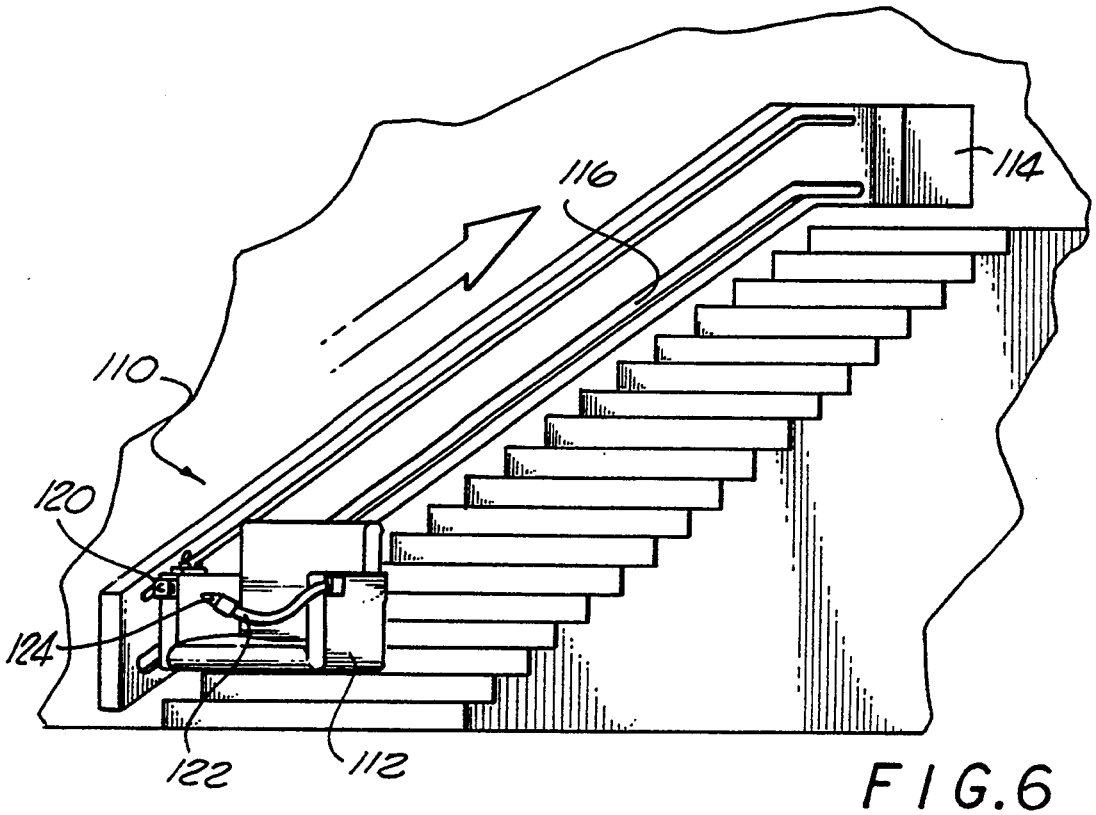
FIG. 6 is an elevational view, partially cut away of a stairway containing another embodiment of a lift in accordance with the invention.

Referring now to FIG. 6, there is shown a perspective view of another embodiment of a passenger lift in accordance with the invention illustrating a passenger lift operable to transport passengers between upper and lower floors of a building separated by a stairway. The passenger lift 110 includes a mobile chair 112 that is driven between the two floors and a drive actuating means 114 located at the upper floor for moving the chair along a rail 116 extending from the drive actuating means to the lower floor along the stairway.

A buckle 120 is connected to one side of the chair 112. One end of a flexible strap 122 is connected to the other side of the chair 112. The other end of the flexible strap 122 terminates in a tab 124, which matingly interlocks with the buckle 120. The buckle 120 and the strap 122 are positioned along the seat, so that when they are interlocked they extend across the lap of a passenger occupying the seat.

A normally open electric switch is located inside the buckle. The switch is operatively connected to the main control power circuit. When the switch is open, i.e. when the belt is not buckled, all lift functions are disabled. When the tab is inserted, the switch is closed and the lift functions actuated.

I claim:

1. An assembly for lifting a passenger comprising:
   - a mobile platform that is driven to transport passengers between different levels, the platform defining a lift surface with a front edge and two opposing sides;
   - a drive means for actuating the platform between the different levels to perform a lift operation, and including a switch for controlling the drive means;
   - spaced apart side passenger supports extending along at least a portion of each of the opposing sides above the lift surface;
   - a restraining belt comprising:
     - a buckle connected to one of the side passenger supports;
     - a strap attached to the opposing side passenger support terminating in a tab adapted to interlock with the buckle, the buckle and the strap fixed along the side passenger supports, so that when the buckle and tab are interlocked a safety restraint is formed between the passenger on the lift platform and the front edge of the lift platform; and
     - a safety interlock disposed in the buckle, for disabling the switch of the actuating means to thereby inhibit said lift operation, unless the buckle and the tab are interlocked.

2. The assembly in accordance with claim 1, wherein the safety interlock comprises a normally open electric switch.

3. The assembly in accordance with claim 2, wherein the platform defines a surface for transporting passengers into and out of vehicles.

4. The assembly in accordance with claim 3, wherein the platform defines a surface for transporting passengers in wheelchairs.

5. The assembly in accordance with claim 2, wherein the platform defines a surface for transporting passengers between floors of a building.

6. The assembly in accordance with claim 5, wherein the lift platform comprises a chair, the restraining belt extending across the lap of a passenger occupying the chair.

7. An assembly for lifting a passenger comprising:

a mobile chair having opposing sides that is driven to transport passengers between different levels;

a drive means for actuating movement of the chair between the different levels to perform a lift operation, and including a switch for controlling the drive means;

a restraining belt adapted to cross the lap of a passenger occupying the chair, the restraining belt comprising:

a buckle connected to one of the opposing sides of the chair;

a strap attached to the other opposing side of the chair and terminating in a tab adapted to interlock with the buckle, the buckle and the strap fixed along the opposing sides, so that when the buckle and tab are interlocked a safety restraint is formed across the lap of a passenger occupying the chair; and a safety interlock disposed in the buckle, for disabling the passenger-operated manual switch of the actuating means to thereby inhibit said lift operation, unless the buckle and the tab are interlocked.

8. The assembly in accordance with claim 7, wherein the safety interlock comprises a normally open electric switch.

9. The assembly in accordance with claim 8, wherein the chair defines a seat for transporting passengers between floors of a building.

* * * * *

UNITED STATES PATENT AND TRADEMARK OFFICE

CERTIFICATE OF CORRECTION

PATENT NO. : 5,373,915
DATED : December 20, 1994
INVENTOR(S) : Jules M. Tremblay It is certified that error appears in the above-indentified patent and that said Letters Patent is hereby corrected as shown below:

Column 1, line 8, change "our" to --an--.

Signed and Sealed this

Twenty-first Day of March, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,373,915

DATED : December 20, 1994

INVENTOR(S) : Jules M. Tremblay

It is certified that error appears in the above-indentified patent and that said Letters Patent is hereby corrected as shown below:

Column 1, line 9, change "our" to --on--.

Signed and Sealed this

Sixth Day of June, 1995

*Attest:*

*Attesting Officer*

BRUCE LEHMAN

*Commissioner of Patents and Trademarks*